United States Patent [19]

Johnson et al.

[11] Patent Number: 4,863,409

[45] Date of Patent: Sep. 5, 1989

[54] METHOD AND APPARATUS FOR AID IN LIFESAVING OPERATIONS ON WATER

[76] Inventors: Russell R. Johnson, 695 E. Patriot Blvd. #78, Reno, Nev. 89511; James L. Parker, 30063 Torre Pines, Agoura, Calif. 91301

[21] Appl. No.: 67,287

[22] Filed: Jun. 29, 1987

[51] Int. Cl.[4] ..... B63C 9/00

[52] U.S. Cl. ..... 441/80; 441/112

[58] Field of Search ..... 411/80, 83, 84, 88

[56] References Cited

U.S. PATENT DOCUMENTS

| | | | |
|---|---|---|---|
| 2,368,558 | 1/1945 | Maloney | 441/84 |
| 4,194,257 | 3/1980 | Martin et al. | 441/80 |
| 4,567,961 | 2/1986 | Schoenfeld | 441/84 |
| 4,666,017 | 5/1987 | Zimmerman | 441/80 |

FOREIGN PATENT DOCUMENTS

| | | | |
|---|---|---|---|
| 2736873 | 3/1979 | Fed. Rep. of Germany | 441/80 |
| 2105411 | 4/1972 | France | 441/84 |
| 716635 | 10/1954 | United Kingdom | 441/80 |
| 2183555 | 6/1987 | United Kingdom | 441/80 |

*Primary Examiner*—Sherman D. Basinger
*Assistant Examiner*—Stephen P. Avila
*Attorney, Agent, or Firm*—Herbert C. Schulze

[57] ABSTRACT

A method, and apparatus, for performing the method, for assisting in the rescue of persons from water which comprises the attachment of a highly visible and easily contacted means in cooperation with a life jacket or the like, which means can be safely snared by a hook or the like without danger to the person wearing the life jacket for purposes of retrieval to a boat or the like, together with cooperative handle means for pulling such person into a boat or the like and out of the water.

3 Claims, 2 Drawing Sheets

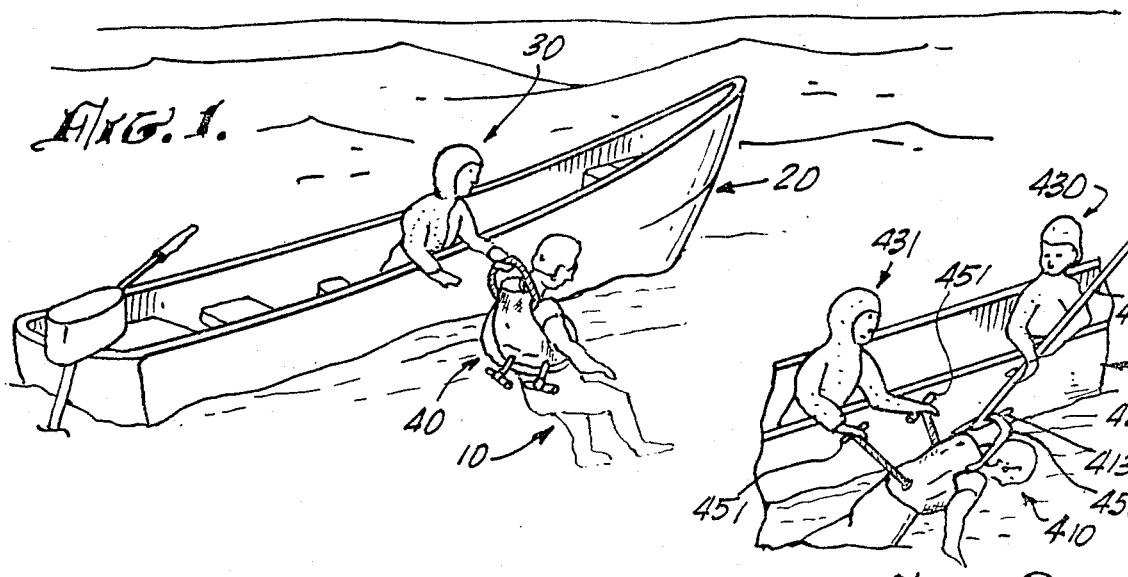
FIG. 1.
FIG. 9.
FIG. 2.
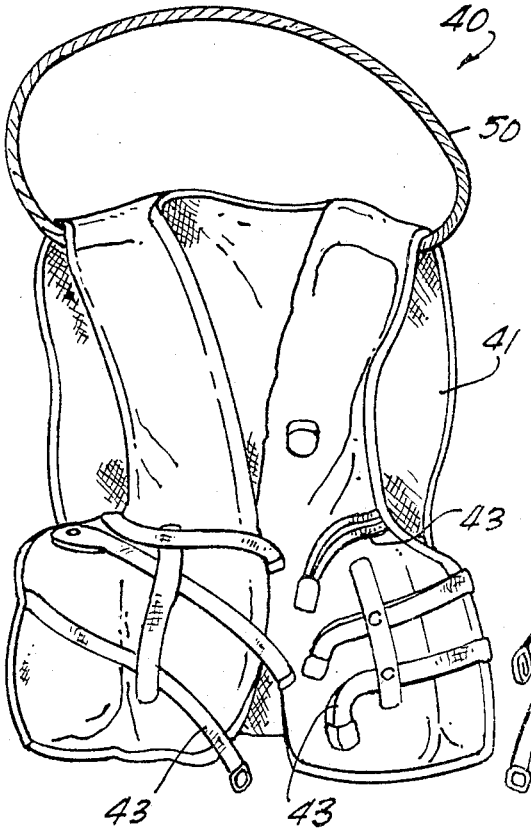
FIG. 3.
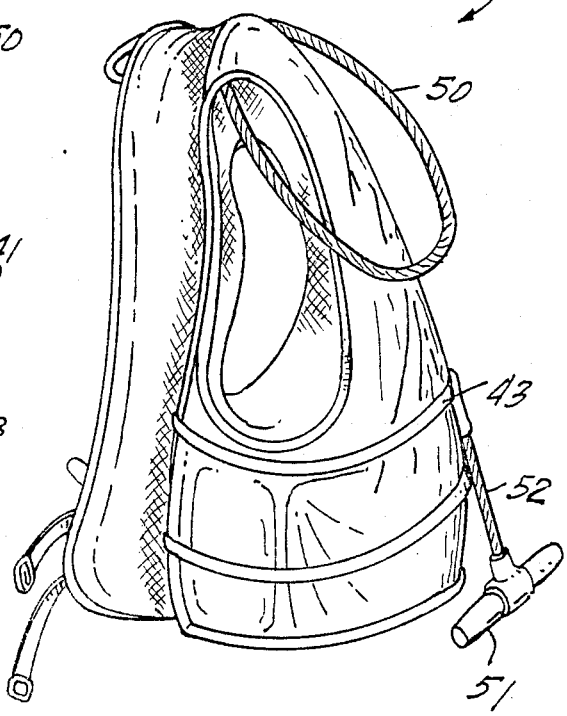

FIG. 4.
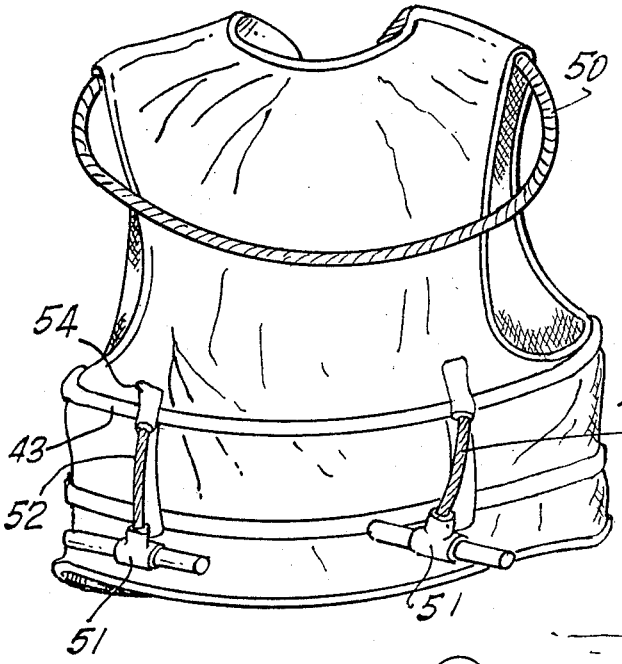
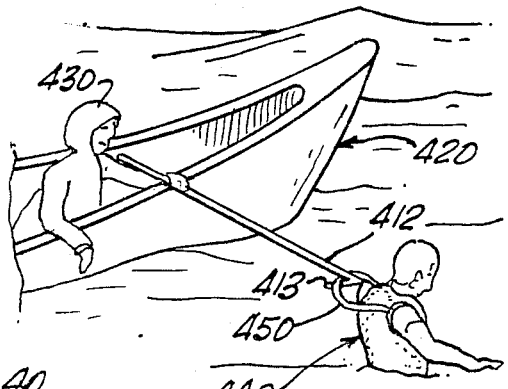
FIG. 5.
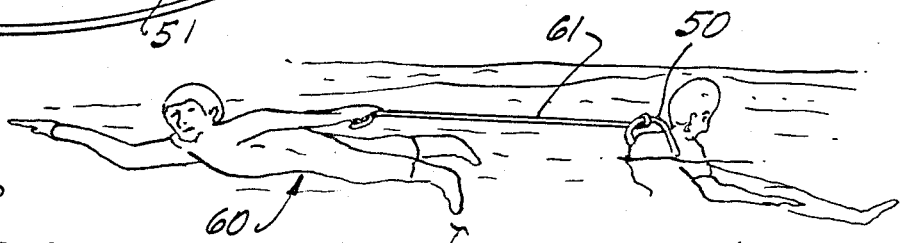
FIG. 6.
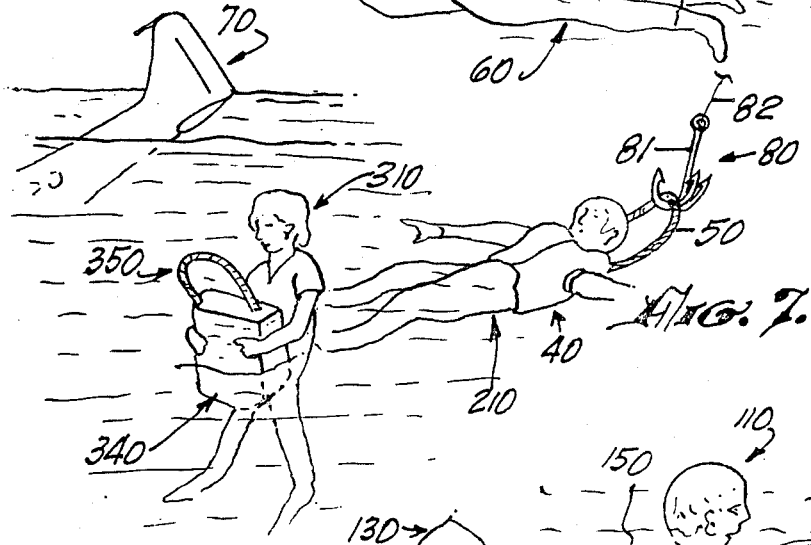
FIG. 7.
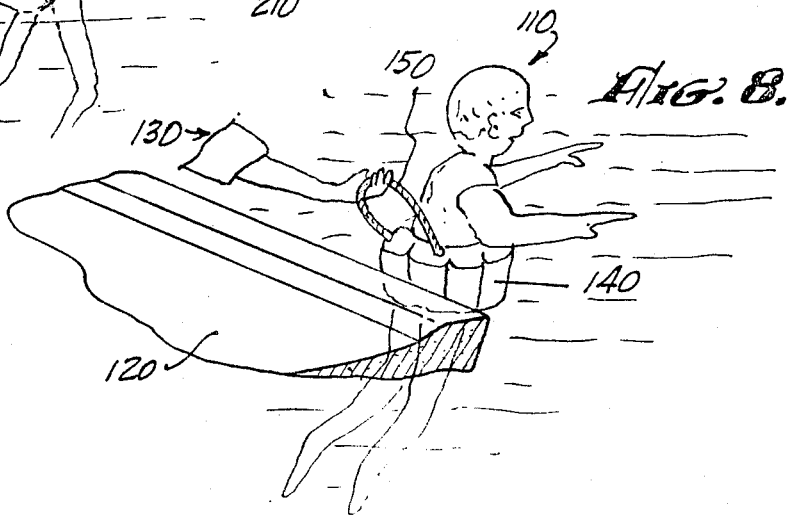
FIG. 8.

METHOD AND APPARATUS FOR AID IN LIFESAVING OPERATIONS ON WATER

CROSS REFERENCE TO RELATED PATENT APPLICATIONS

There are no patent applications filed by us related to this application.

BACKGROUND OF THE INVENTION

I. FIELD OF THE INVENTION

This invention is in the field of lifesaving apparatus; it is more particularly directed to lifesaving apparatus being used by persons in water; the invention is even more particularly directed at a method and apparatus for retrieving a person floating in the water with the aid of a flotation device; and it is even more particularly directed to such retrieval in combination with means to assist, complement and improve on prior art methods or apparatus by which a person, particularly in rough seas or the like, can be safely snared by means cooperative with the flotation device by which such person may be easily lifted from the water and into a boat or the like.

II. DESCRIPTION OF THE PRIOR ART

There is no prior art known to us directly related to this invention. The invention defines flotation devices for use by human beings which will allow safe handling in rough seas and the like by providing special restraining and lifting devices.

In the past, the prior art has been devoid of this type of apparatus, leaving it to attempts somehow snare or otherwise catch the flotation device itself, without the utilization of specially designed auxiliary snaring attachments or the like.

SUMMARY OF THE INVENTION

There are many instances in which persons are floating in water, particularly in the sea or a lake, but in any water condition, where they have been placed in danger by reason of some mishap and find themselves floating with the use of a flotation aid such as a life jacket, life buoy, flotation seat cushion from an aircraft, inflatable vests, or the like. Under such circumstances, a person floating in the water, particularly in very heavy seas, wherein such person is most difficult to grasp from a boat, platform, or other rescue location. Frequently it is next to impossible to grasp such a person due to the danger not only to the person in the water, but to the would-be rescuer. The problem is that until control can be obtained over the person in the water he can be seriously injured or killed by bumping against a boat or the like which is bouncing or moving forcefully under the force of high seas. Until a degree of control can be exercised over the person in the water it is a dangerous situation for all concerned. Under certain circumstances it will be possible that a rescue boat or the like will carry a long handled hook or the like in order to attempt to reach out to someone in the water. However, this is not satisfactory under rough sea conditions since such a device can seriously injure the person being sought to be rescued because of uncontrolled movement due to the seas. Additionally, such a device can damage certain types of flotation aids such as inflatable flotation aids and the like. Another problem in such rescue circumstances is that the person being rescued, when he is finally brought close to the boat or the like which is rescuing him cannot be adequately handled so as to bring him into the safety of the boat without serious risk of injury and even the risk of the rescuers themselves being thrown into the sea. The reason for this is that there is generally no convenient way to hold on to such a person who is in the sea. The life jackets themselves provide very little to grasp, and the arms, legs and other parts of the body of the person being rescued do not provide much to grasp firmly in order to hoist a person into the boat. This is further complicated, usually, by the fact that the person who is being rescued may be unconscious or nearly unconscious and thus not able to assist in his own rescue.

We have now devised a method and the apparatus to perform such method whereby a life jacket or a flotation aid may be equipped with a suitable means to be hooked or otherwise snared by a device which might be dangerous under other circumstances at the same time, keeping such device out of the way of the user until such time as it is actually needed.

We have further provided handles suitable to be gripped by rescuers in order to lift the person being rescued easily and quickly from the water without the usual danger of injury from the tossing boat or the like and without danger to the rescuers.

We have accomplished the foregoing by providing loops of various configurations which are attached to flotation devices in such a manner that they will float at a distance from the person wearing the flotation device when in the water, and which can be easily snared by a hook or other snaring device without danger of injuring the person wearing the flotation device.

We have provided this in several different configurations since there are a number of different types of flotation devices which must be considered.

The aim of this invention is to provide such a snaring appendage to the flotation device as has been decribed so that the victim in the water may be snared without danger of harming him and may be pulled to the immediate vicinity of the boat or the like. Additionally, handle devices have been provided so that an unconscious or conscious person may be easily handled by and lifted from the water by rescuers in a small boat, large boat, or any other rescue vessel or position.

A number of different modifications have been made by us depending upon the particular flotation device being used. For example a different situation exists with a standard life vest as is worn by most boaters and an aircraft flotation cushion. Likewise a somewhat different technique may be applied with inflatable life vests or the like. Even ordinary life rings or the like may be provided with an apparatus according to this invention.

The floating snaring device will normally be florescent or reflective or both to provide maximum visibility under the adverse conditions which frequently exist in a rescue situation at sea.

In alternate forms the snaring device may be caused to rise from the water by suitable means which are described in the description of a preferred embodiment so that it can be hooked most easily by a helicopter or the like. All of these thoughts are in mind in the devising of different forms of this apparatus although the single method remains rather controlling as the method being to provide first a snaring device which will not interfere with ordinary use of a flotation device together with handle means which will not interfere with the normal use of the flotation device.

It is an object of this invention to provide a method to enable persons wearing flotation devices in water to be snared without danger;

Another object of this invention is to provide such a snaring means which will be readily visible and easily contacted without danger to the person wearing the flotation device;

Another object of this invention is to provide such a snaring device in combination with a flotation device and in further combination with handles upon the flotation device to assist in lifting the person wearing the flotation device from the water.

The foregoing and other objects and advantages of this invention will become apparent to those skilled in the art upon reading the description of a preferred embodiment which follows in conjunction with a review of the appended drawings.

BRIEF DESCRIPTION OF THE DRAWINGS

FIG. 1 shows in perspective a view of a person rescuing another person from the water utilizing the method and apparatus of this invention;

FIG. 2 illustrates the particular appendages which may be applied to an ordinary life jacket to enable the rescue as set forth in FIG. 1;

FIG. 3 illustrates the additional use of handles for handling such persons;

FIG. 4 is another illustration in more detail of FIGS. 2 and 3;

FIG. 5 illustrates how a boat hook may be used in order to rescue a person utilizing the apparatus and method of this invention;

FIG. 6 illustrates how the method and apparatus of this invention may be used by a swimmer in the water to assist a person who has been rendered unconscious or otherwise;

FIG. 7 illustrates the use of this method and apparatus in aircraft crash situations over water;

FIG. 8 further illustrates the ability to handle such a person as is being rescued by the method and apparatus of this invention;

FIG. 9 illustrates ultimate disposition of the person being rescued into a boat, or the like.

DESCRIPTION OF A PREFERRED EMBODIMENT

All of the figures in the preferred embodiment must be viewed in total context with one another.

In FIG. 1 there is shown a boat 20 with an occupant 30, wherein a victim 10 wearing life jacket or the like 40 equipped with suitable means to practice this invention, is being lifted from the water;

FIG. 2 illustrates the loop 40, particularly being used in FIG. 1 to grasp and control the individual 10;

The various elements of the jacket, being flotationary at 41 and the fastening elements 43 are well known to those skilled in the art and need not be described in further detail.

FIG. 3 is a further illustration showing, in addition to a loop 50 for snaring the individual, a handle 51 attached by rope or the like 52 to the life jacket at 43;

FIG. 4 shows once again the elements previously described with the loop 50, life jacket 40, attachments at 54 and 43 to the handle units 51 through connecting elements 52;

FIG. 5 shows the occupant 430 of boat 420 snaring a victim in the water by use of a boat hook 412. Normally this would be a very dangerous operation. However with the floating loop 450, it is quite easy for the hook 413 to grasp the same without danger to the occupant 440;

FIG. 6 illustrates an individual who has become incapacitated by numeral 50 being towed by a line 61 by swimmer 60;

FIG. 7 is particularly important in view of recent tragic accidents at sea by aircraft. Aircraft 70 is shown partially submerged. An occupant of the aircraft 310 is shown to be grasping a seat cushion or the like which is commonly supplied on such aircraft 340, by the added loop element 350 of this invention;

Further, the same figure shows the elevation of a victim 210 wearing a flotation of this invention 40, wherein a lifting hook 81 from a helicopter has been snared in to the snaring device 50 of this invention and will now be lifted safely to a helicopter or the like;

FIG. 8 shows a somewhat different situation where the victim 110 is floating in the water, but has been grasped by an occupant of the boat 120 by arm 130 handling the handle 150. The ordinary flotation device 140 is inoperative at this point since now it has become time to pull the victim into the boat.

FIG. 9 illustrates, perhaps most importantly, the real and unique value of this invention. In FIG. 9 there is shown a boat 420 with two occupants 430 and 431, one occupant holding a boat hook 412 which has been hooked into loop 450 by the hook element 413 on the boat hook.

Under rough seas, which is a frequent condition encountered, the occupants of the boat at this point would be in a precarious position as well as the victim 410.

Those skilled in this particular type of activity recognize that the victim can easily be crushed against the boat and likewise the occupants can easily fall out of the boat attempting to get a proper hold on the victim.

By the use of the handles 451 which will be floating free, the boat occupant 431 can obtain firm control of the basic portion of the body. At the same time, boat occupant 430 can, with the loop 450, aid, and the victim 410 can be easily lifted into the boat without danger of crushing him against the boat due to the sea activity and also with no reasonable possibility that either of the boat occupants will be pulled over and into the water.

This invention is directed to the method and apparatus for the careful, economical, and safe handling of victims of boating accidents wherein the victim is in the water and without any real sufficient means of assistance.

While the embodiments of this invention shown and described are fully capable of achieving the objects and advantages described, it is to be understood that such embodiment is for purposes of illustration only and not for purposes of limitation.

We claim:

1. Apparatus for rescuing persons downed in a water body comprising a customary flotation device; an auxiliary snaring device of semi-rigid material attached to the floatation device adjacent the shoulder area thereof in such manner that said snaring device has a natural tendency to depend upwardly and outwardly away from the head and body of the wearer of such device, and a further handling device comprising a hand grippable handle of material which floats in the water and is attached to the flotation device at a point approximating the waist of the wearer of such device.

2. The apparatus of claim 1 wherein both the snaring device and the handling device will float upwardly and away from the body of the wear of the floatation device in such manner that they may be grasped from a boat while the wearer of the floation device is still at a distance from the boat.

3. The apparatus of claim 2 wherein the snaring device is suitable to be snared at a distance from the head and body of the user of the flotation device by a grappling hook without danger to the head or body of the user of the flotation device.

* * * * *